US008517120B2

(12) United States Patent
Hallundbaek

(10) Patent No.: US 8,517,120 B2
(45) Date of Patent: Aug. 27, 2013

(54) PERFORATION TOOL WITH SWITCH

(75) Inventor: Jørgen Hallundbaek, Graested (DK)

(73) Assignee: Welltec A/S, Allerod (DK)

( * ) Notice: Subject to any disclaimer, the term of this patent is extended or adjusted under 35 U.S.C. 154(b) by 426 days.

(21) Appl. No.: 12/532,037

(22) PCT Filed: Mar. 19, 2008

(86) PCT No.: PCT/DK2008/000112

§ 371 (c)(1),
(2), (4) Date: Nov. 4, 2009

(87) PCT Pub. No.: WO2008/113357

PCT Pub. Date: Sep. 25, 2008

(65) Prior Publication Data

US 2010/0108378 A1 May 6, 2010

(30) Foreign Application Priority Data

Mar. 22, 2007 (DK) ..... 2007 00441

(51) Int. Cl.
*E21B 43/11* (2006.01)

(52) U.S. Cl.
USPC ..... 175/4.55; 175/4.56; 166/55

(58) Field of Classification Search
USPC ..... 175/4.55, 4.56; 166/297, 55
See application file for complete search history.

(56) References Cited

U.S. PATENT DOCUMENTS

| | | | | |
|---|---|---|---|---|
| 2,540,184 | A | 2/1951 | Broyles | |
| 2,587,723 | A | 3/1952 | Githens et al. | |
| 3,116,689 | A * | 1/1964 | Sumner | 175/4.53 |
| 3,208,378 | A | 9/1965 | Boop | |
| 3,517,758 | A * | 6/1970 | Schuster | 175/4.55 |
| 3,955,508 | A | 5/1976 | Will et al. | |
| 4,778,009 | A | 10/1988 | Summer et al. | |
| 4,852,494 | A | 8/1989 | Williams | |
| 5,095,801 | A * | 3/1992 | Lopez de Cardenas | 89/1.15 |

* cited by examiner

*Primary Examiner* — Daniel P Stephenson
*Assistant Examiner* — Robert E Fuller
(74) *Attorney, Agent, or Firm* — Cozen O'Connor

(57) ABSTRACT

A perforation tool e.g. for perforation of a formation, a well or the like downhole by detonation of a charge. The perforation tool has at least one charge and at least one switch for detonation of the charge. The switch has a housing, at least one contact, a shaft having a first end with a fastening member enabling a slidable fastening of the shaft in a predetermined position in relation to the tool and a second end for extending into the housing, and a conductor provided on the shaft enabling an electrical current to be conducted between the contact and the for detonation of a charge when the shaft extends within the housing.

23 Claims, 5 Drawing Sheets

PERFORATION TOOL WITH SWITCH

PRIORITY CLAIM

This is a U.S. national stage of application No. PCT/DK2008/000112, filed on Mar. 19, 2008. Priority is claimed on the following applications: Denmark, Application No.: PA 200700441, Filed on Mar. 22, 2007, the content of which is incorporated here by reference.

TECHNICAL FIELD

The present invention relates to a perforation tool with a perforation switch for detonation of a charge.

BACKGROUND

Perforation tools are used for completion of an oil or gas well by blasting tunnels into the formation allowing oil or gas to flow into the wellbore. Perforation tools are often conveyed by a wireline or a downhole tractor.

A perforation tool usually comprises several charges which are to be detonated sequentially in accordance with a detonation plan. Separate relays may be used for detonation of each of the charges, or the same relay may be used for all of the charges.

Shaking and bumping of the tool during transport or a shock from the detonation of a previous charge cause the relay to first disconnect and then reconnect, and sparks are thus generated. When a spark is generated, small fragments are deposited on the pin and the contact of the relay. Therefore, the relay may not always function when needed since the amount of deposit may have become too great for electrical connection to be obtained.

DESCRIPTION OF THE INVENTION

An aspect of the present invention is, at least partly, to overcome the disadvantages of the perforation tool mentioned above, and to provide an improved switch which can withstand bumping or shaking from transport of the tool and/or from a shock from a previous detonation, and still be able to detonate a charge when needed.

This aspect and the advantages becoming evident from the description below are obtained by a perforation tool e.g. for perforation of a formation, a well, or the like down-hole by detonation of a charge, comprising:

at least one charge, and at least one switch for detonation of the charge, wherein the switch comprises:

a housing, at least one contact means, a shaft having a first end with a fastening means and a second end for extending into the housing, and a conductive means provided on the shaft enabling an electrical current to be conducted between the contact means and the conductive means for detonation of a charge when the shaft extends within the housing.

In one embodiment, the fastening means of the first end of the shaft enables a slidable fastening of the shaft in a predetermined position in relation to the tool.

By slidable fastening is meant that the fastening means can maintain the contact means in position when the shaft is not moved deliberately, whereas the position of the shaft and the contact means can easily be changed when necessary. By having a fastening means enabling a slidable fastening of the shaft, the contact means is thus maintained in its predetermined position during any bumping from a shock from a previous detonation when the shaft is not deliberately moved. In this way, the contact means is hindered from generating sparks, depositing fragments, and destroying the functionality of the switch.

In another embodiment, the fastening means may be a screw thread interacting with an internal thread of the housing or a casing of the tool or with a gear means of the perforation tool for driving the conductive means on the shaft into and out of contact with the contact means.

In yet another embodiment, the shaft may interact with an internal thread of the housing or a casing of the tool by a tongue-and-groove joint for driving the conductive means on the shaft into and out of contact with the contact means, where the groove is L-shaped so that the tongue may be fastened in the groove and not slide unintendedly.

By having a threaded shaft interacting with an internal thread of the housing or a casing of the tool, the conductive means on the shaft may rotate for movement of the shaft into contact with the contact means while at the same time being held firmly in place during any pumping or shock from a previous detonation.

In addition, the switch may comprise a plurality of contact means.

In one embodiment, the conductive means may be constituted by a cylindrical conductive area of the shaft, meaning that the conductive connection between the conductive means and the contact means is independent of the position of the screw of the shaft.

In another embodiment, the shaft may comprise several cylindrical conductive areas, the areas between the cylindrical conductive means being made of a non-conductive material.

In yet another embodiment, the shaft may comprise several cylindrical conductive areas, the areas between the conductive areas having a smaller diameter than that of the conductive areas.

In one embodiment, the contact means may be in the form of a ring.

Moreover, the contact means may comprise a first and a second contact which are provided in a distance from one another along an inner diameter of the housing, and an electrical current can be transferred from the first contact to the second contact via the conductive means for detonation of the charge.

In one embodiment, the first and the second contacts may be comprised in one ring of a non-conductive material.

Moreover, the first and the second contacts can be positioned opposite one another along the inner diameter of the housing.

In addition, the perforation tool may comprise one switch for each charge.

In another embodiment, the perforation tool may comprise one switch for several charges.

Furthermore, the invention relates to a switch in accordance with the above.

BRIEF DESCRIPTION OF THE DRAWINGS

The invention is explained in detail below with reference to the drawings, in which.

The drawings are merely schematic and shown for an illustrative purpose.

DETAILED DESCRIPTION OF THE INVENTION

Figure 1:
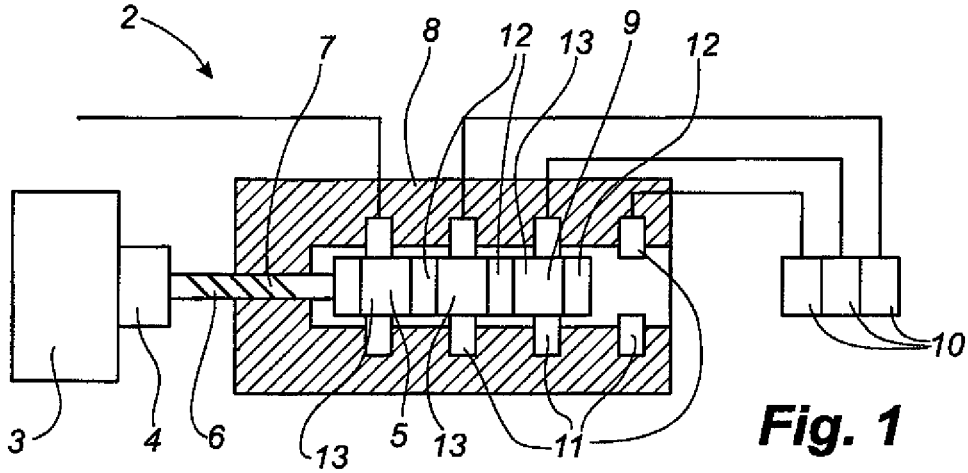
FIG. 1 shows a sectional view of a perforation tool according to the invention.

A partial view of the perforation tool 1 is shown in FIGS. 1-5. In FIG. 1, the perforation tool 1 is shown having a power means 3 for powering a switch 2. The switch 2 is connected to the power means 3 through a gear means 4. The gear means 4 drives the switch 2 forward by turning a shaft 5 which has a threaded part 6 in a first end 7. The switch 2 further comprises a housing 8 into which a second end 9 of the shaft extends when the switch 2 connects to make a charge 10 detonate.

The switch 2 comprises four contact means 11 provided in the housing 8. The contact means 11 are here shown in the form of rings extending around the shaft 5. The rings are placed at a distance along the longitudinal extension of the housing 8. The switch 2 further comprises a number of conductive means 12 situated on the shaft 5 for conducting an electrical current to the contact means 11 when the shaft 5 is driven into the housing 8. The conductive means 12 are situated at a distance from one another along the shaft 5, and non-conductive material 13 is provided between the conductive means 12.

When the power means 3 via the gear means 4 turns the shaft 5, the shaft 5 is driven forward into the housing 8 due to the threaded connection between the housing 8 and the shaft 5. Thus, one by one, the contact means 11 are brought into conductive connection with the conductive means 12.

Figure 10:
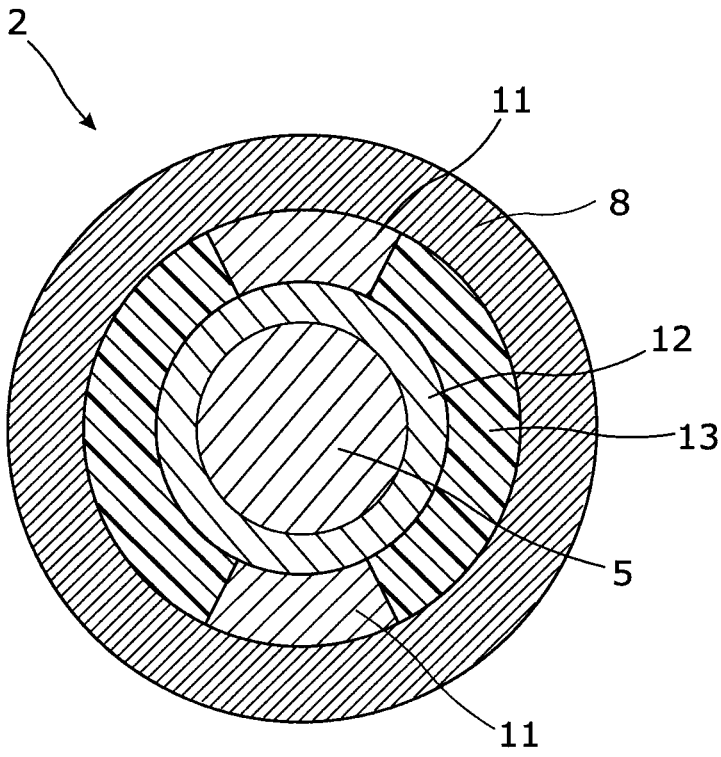
FIG. 10 is a cross-sectional view of the perforation tool with switch depicted in FIG. 1.

In another embodiment, as shown in FIG. 10, it is the contact means 11 which conduct an electrical current to the conductive means 12. The contact means 11 may also comprise two contacts, namely a first and a second contact that are placed opposite one another in the housing 8 of the switch 2. The first and the second contact can be placed at a distance from each other along a ring which is made of a non-conductive material 13, such as plastic, a ceramic material, or the like. In yet another embodiment, the contacts may be positioned at arbitrary positions along the inner circumference of the housing 8.

The conductive means 12 are shown as four separate conductive areas, but may as well be just one area that is brought into contact with one contact means 11 at a time, a charge thus being detonated each time a contact means 11 is brought into contact with the conductive means 12.

Figure 2:
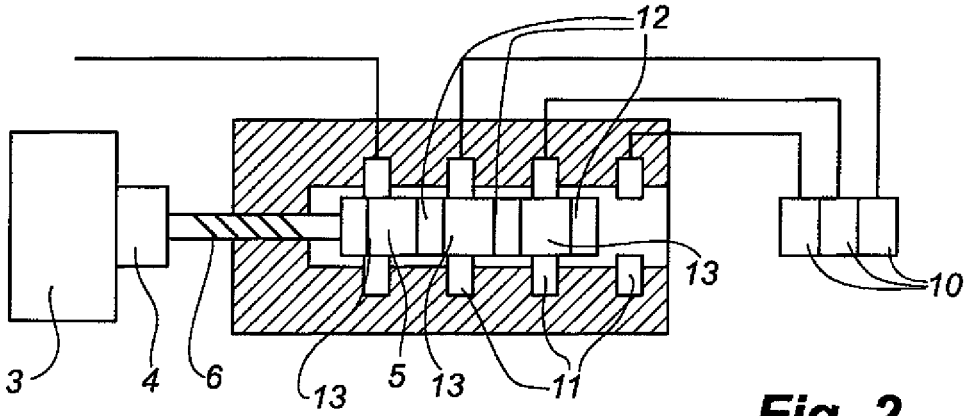
FIG. 2 shows a sectional view of the perforation tool of FIG. 1 in which a first contact has been made.
Figure 3:
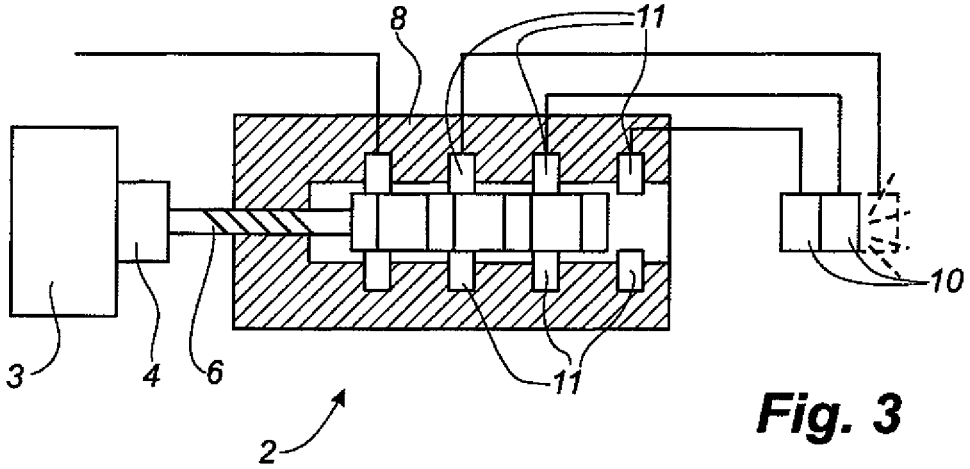
FIG. 3 shows a sectional view of the perforation tool of FIG. 1 in which a second contact has been made.
Figure 4:
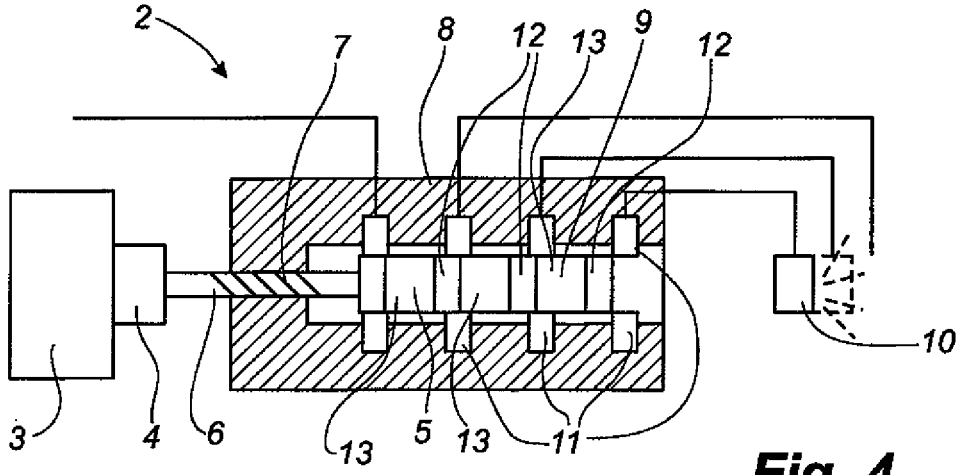
FIG. 4 shows a sectional view of the perforation tool of FIG. 1 in which a third contact has been made.
Figure 5:
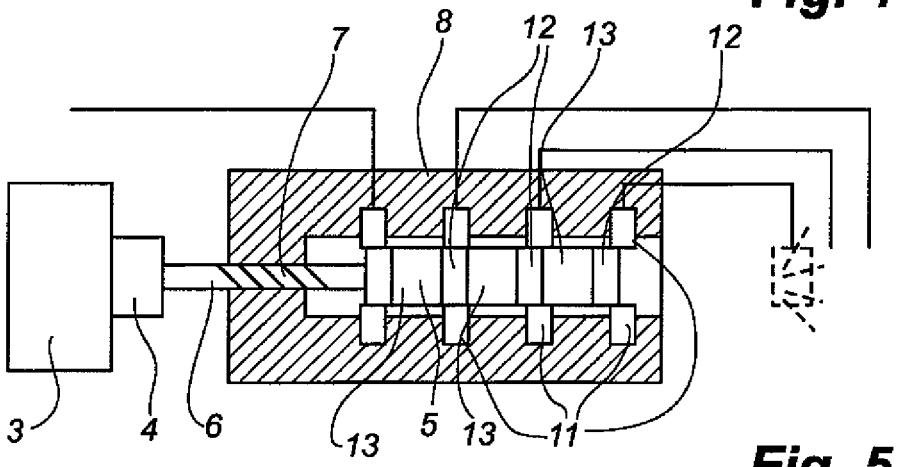
FIG. 5 shows a sectional view of the perforation tool of FIG. 1 in which a fourth contact has been made.

The first contact means 11, shown in FIGS. 1-5, is used as a control contact so that the operator knows the actual position of the switch 2. Such a control contact is merely a further safety device and may be dispensed with. FIG. 1 shows the switch 2 out of contact with any of the contact means 11. FIG. 2 shows the control contact in contact with a conductive means 12. FIG. 3 shows the second contact means 11 in contact with the second conductive means 12 for firing a first charge 10. FIG. 4 shows the third contact means 11 in contact with the third conductive means 12 for firing a second charge 10. FIG. 5 shows the fourth contact means 11 in contact with the fourth conductive means 12 for firing a third charge 10.

The perforation tool 1 may have one or more charges 10 depending on the purpose of the operation. Furthermore, all of the charges 10 may be fired at once by bringing one or more of the contact means 11 into contact with a conductive means 12. The perforation tool can be preset as to which contact means brought into contact with a conductive means results in a firing of all of the charges. The charges 10 are shown as positioned on one line, but may as well be positioned on different lines at different places along the circumference of the tool 1, thus enabling the blasting of side channels.

Figure 6:
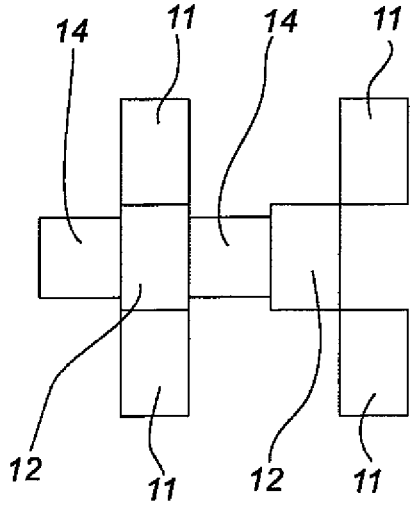
FIG. 6 shows a partial view of a second embodiment of the switch according to the invention.

In FIG. 6, the connection between the contact means 11 and the conductive means 12 is shown. In this embodiment, the detonation of the charge occurs at the moment the second contact means 11 makes contact with the edge of the conductive means 12.

Furthermore, the intervening sections 14 between the conductive means 12 are shown having a lesser diameter than the diameter of the conductive means 12. In this way, the intervening sections 14 can be made of the same material as the conductive means 12.

Figure 7:
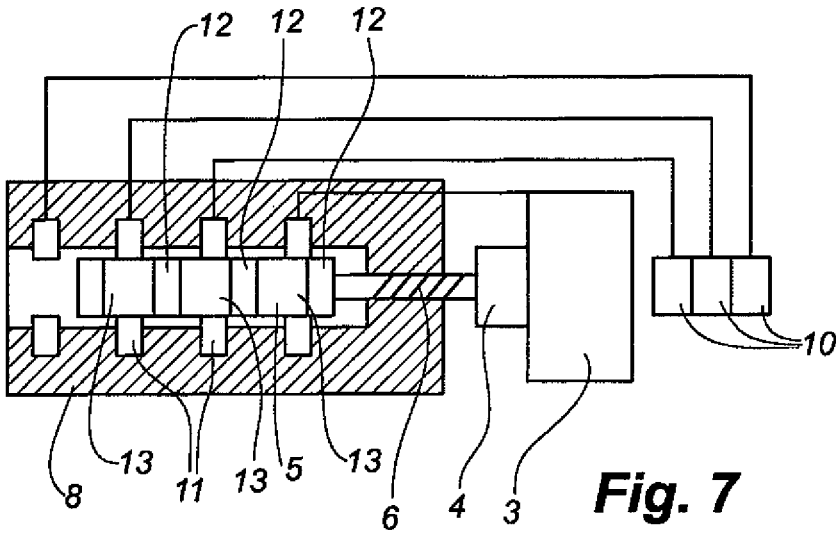
FIG. 7 shows a third embodiment of the switch of the invention.

In FIG. 7, another embodiment of the perforation switch 2 is shown in which the motor 3 is positioned between the switch 2 and the charges 10.

The housing 8 is shown as closed by the threaded part 6 of the shaft 5 at one end, and open at the other end. The housing 8 can be closed at the other end, thus hindering dirt and the like from entering.

In order to compensate for any unwanted play in the screw thread 6 of the shaft 5, a spring means is provided in the closed other end of the housing 8. In this way, no play or slack will cause an unwanted fast, forward movement of the shaft 5 into the housing 8.

Figure 8:
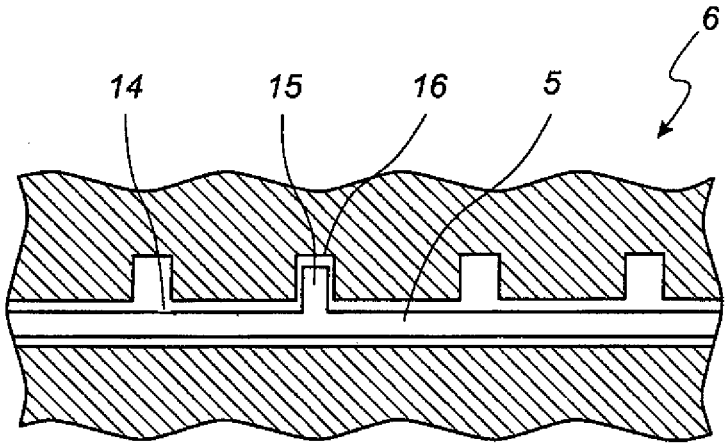
FIG. 8 shows a partial view of another embodiment of the switch in which the fastening means fastens the shaft.

In FIGS. 1-5 and 7, the fastening means 6 is shown as a screw engaging with a thread. However, the fastening means may also be a channel 14 with side grooves 16, in which channel 14 a pawl 15 on the shaft 5 slides in and out of engagement with a side groove 16. The channel 14 with side grooves 16 is provided in the housing as shown in FIG. 8. FIG. 8 is a partial view of a switch in which the fastening means 6 fastens the shaft in that the pawl 15 of the shaft engages with a side groove 16. When the pawl 15 engages with a predetermined side groove, the contact means comes into contact with the conductive means and a signal is send of the position of the switch or to detonate a charge.

Figure 9:
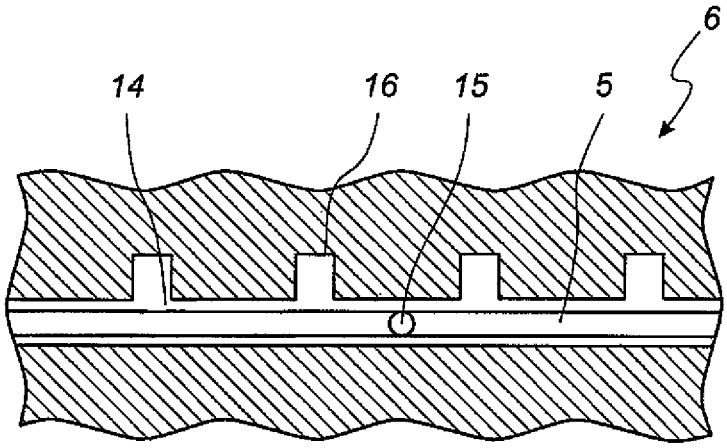
FIG. 9 shows a partial view of the same embodiment of the switch, wherein the fastening means of FIG. 8 slides prior to a new fastening of the shaft.

FIG. 9 shows a partial view of the same embodiment of the switch. The fastening means is here seen in its slidable position before sliding into engagement with a subsequent side groove 16 for providing a new fastening of the shaft, and thus before the contact means comes into contact with the conductive means for conducting an electrical current and thereby a signal.

In this embodiment, the power means 3 is an electrical motor powered from above surface through a wireline, but it may as well run on battery downhole.

In the event that the perforation tool is not submergible all the way into the casing, a downhole tractor can be used to push the perforation tool all the way into position in the well. A downhole tractor is any kind of driving tool capable of pushing or pulling tools in a well downhole, such as a Well Tractor®.

The invention claimed is:

1. A perforation tool for perforation of a formation or a well downhole by detonation of a charge, comprising:

at least one charge, and at least one switch for detonation of the at least one charge, wherein the switch comprises:

a housing, at least one contact means fixed in the housing, a shaft having a longitudinal axis and a first end with a fastening means enabling a fastening of the shaft in a predetermined position in relation to the housing, the shaft being extendable within the housing along the longitudinal axis, and a conductive means fixed on the shaft and providing an electrical current to be conducted between the contact means and the conductive means when the contact means and the conductive means are in electrical contact with each other for detonation of the at least one charge wherein the fastening of the shaft is configured to maintain along the longitudinal axis a relative position between the at least one contact means and the conductive means substantially constant in an absence of an influence of power means and allow the relative position between the at least one contact means and the conductive means along the longitudinal axis to change under the influence of the power means to enable detonation of the at least one charge when the contact means and the conductive means are brought into electrical contact with each other, and wherein the fastening means is a screw thread that interacts with at least one of an internal thread of the housing and a gear means of the perforation tool for driving the conductive means on the shaft into and out of contact with the contact means.

2. The perforation tool according to claim 1, wherein the switch comprises a plurality of contact means.

3. The perforation tool according to claim 1, wherein the conductive means is constituted by at least one cylindrical conductive area of the shaft such that the conductive connection between the conductive means and the contact means is independent of the position of the screw thread.

4. The perforation tool according to claim 3, wherein the shaft comprises several cylindrical conductive areas, the areas between the cylindrical conductive means being made of a non-conductive material.

5. The perforation tool according to claim 4, wherein the shaft comprises several cylindrical conductive areas, the areas between the conductive areas having a smaller diameter than that of the conductive areas.

6. The perforation tool according to claim 3, wherein the shaft comprises several cylindrical conductive areas, the areas between the conductive areas having a smaller diameter than that of the conductive areas.

7. The perforation tool according to claim 1, wherein the contact means is in the form of a ring.

8. The perforation tool according to claim 1, wherein the contact means comprises a first and a second contact which are provided at a distance from one another along an inner diameter of the housing, and wherein an electrical current is transferred from the first contact to the second contact via the conductive means for detonation of the at least one charge.

9. The perforation tool according to claim 8, wherein the first and the second contacts are disposed in one ring of a non-conductive material.

10. The perforation tool according to claim 9, wherein the first and the second contacts are positioned opposite one another along the inner diameter of the housing.

11. The perforation tool according to claim 8, wherein the first and the second contacts are positioned opposite one another along the inner diameter of the housing.

12. The perforation tool according to claim 1, wherein the contact means is in the form of a ring.

13. The perforation tool according to claim 1, wherein the at least one charge is a plurality of charges, and wherein the tool comprises one switch for several of the plurality of charges.

14. A perforation tool for perforation of a formation or a well downhole by detonation of a charge, comprising:

at least one charge, and at least one switch for detonation of the at least one charge, wherein the switch comprises:

a housing, at least one contact means fixed in the housing, a shaft having a longitudinal axis and a first end with a fastening means enabling a fastening of the shaft in a predetermined position in relation to the housing, the shaft being extendable within the housing along the longitudinal axis, and a conductive means fixed on the shaft and providing an electrical current to be conducted between the contact means and the conductive means when the contact means and the conductive means are in electrical contact with each other for detonation of the at least one charge, wherein the fastening of the shaft is configured to maintain along the longitudinal axis a relative position between the at least one contact means and the conductive means substantially constant in an absence of an influence of power means and allow the relative position between the at least one contact means and the conductive means along the longitudinal axis to change under the influence of the power means to enable detonation of the at least one charge when the contact means and the conductive means are brought into electrical contact with each other, and wherein the fastening means is a channel provided in the housing and having side grooves extending perpendicular to the channel, wherein, in said channel, a pawl on the shaft slides in and out of engagement with a side groove.

15. The perforation tool according to claim 14, wherein the switch comprises a plurality of contact means.

16. The perforation tool according to claim 14, wherein the conductive means is constituted by at least one cylindrical conductive area of the shaft such that the conductive connection between the conductive means and the contact means is independent of the position of the pawl of the shaft.

17. The perforation tool according to claim 14, wherein the contact means is in the form of a ring.

18. The perforation tool according to claim 14, wherein the contact means is in the form of a ring.

19. The perforation tool according to claim 14, wherein the at least one charge is a plurality of charges, and wherein the tool comprises one switch for several of the plurality of charges.

20. A perforation tool for perforation of a formation or a well downhole by detonation of a charge, comprising:

at least one charge, and at least one switch for detonation of the at least one charge, wherein the switch comprises:

a housing, at least one contact means fixed in the housing, a shaft having a longitudinal axis and a first end with a fastening means enabling a fastening of the shaft in a predetermined position in relation to the housing, the shaft being extendable within the housing along the longitudinal axis, and a conductive means fixed on the shaft and providing an electrical current to be conducted between the contact means and the conductive means when the contact means and the conductive means are in electrical contact with each other for detonation of the at least one charge, wherein the fastening of the shaft is configured to maintain along the longitudinal axis a relative position between the at least one contact means and the conductive means substantially constant in an absence of an influence of power means and allow the relative position between the at least one contact means and the conductive means along the longitudinal axis to change under the influence of the power means to enable detonation of the at least one charge when the contact means and the conductive means are brought into electrical contact with each other, and wherein the contact means comprises a first and a second contact which are provided at a distance from one another along an inner diameter of the housing, and wherein an electrical current is transferred from the first contact to the second contact via the conductive means for detonation of the at least one charge.

21. The perforation tool according to claim 20, wherein the fastening means is a channel provided in the housing and having side grooves extending perpendicular to the channel, wherein, in said channel, a pawl on the shaft slides in and out of engagement with a side groove.

22. The perforation tool according to claim 20, wherein the first and the second contacts are disposed in one ring of a non-conductive material.

23. The perforation tool according to claim 20, wherein the first and the second contacts are positioned opposite one another along the inner diameter of the housing.

* * * * *